US011802574B2

(12) United States Patent
Shin

(10) Patent No.: US 11,802,574 B2
(45) Date of Patent: Oct. 31, 2023

(54) SOUNDPROOF COVER OF A COMPRESSOR

(71) Applicant: LG Electronics Inc., Seoul (KR)

(72) Inventor: Yongho Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 480 days.

(21) Appl. No.: 16/743,838

(22) Filed: Jan. 15, 2020

(65) Prior Publication Data

US 2020/0248715 A1 Aug. 6, 2020

(30) Foreign Application Priority Data

Feb. 1, 2019 (KR) ..... 10-2019-0013517

(51) Int. Cl.
*F04D 29/66* (2006.01)
*F24F 1/12* (2011.01)

(52) U.S. Cl.
CPC ..... *F04D 29/66* (2013.01); *F24F 1/12* (2013.01)

(58) Field of Classification Search
CPC .. F25B 2500/12; F25B 2500/13; F25B 31/00; F25B 31/02; F24F 2013/242; F24F 13/24; F24F 1/12; F04C 29/065; F04C 29/066; F04C 29/063; F04C 29/06; F04C 2270/12; F04C 2270/13; F04C 2240/30; F04B 39/0027; F04B 39/0033; F04B 39/0044; F04B 53/001; F04B 53/002; F04B 39/121; F24H 1/12
See application file for complete search history.

(56) References Cited

U.S. PATENT DOCUMENTS 4,982,812 A * 1/1991 Hwang ..... F24F 13/24 415/119
4,991,406 A * 2/1991 Fujii ..... F24F 1/40 62/259.1
5,272,285 A * 12/1993 Miller ..... F04C 29/066 181/202
5,588,810 A * 12/1996 DiFlora ..... F04B 39/0033 181/403

(Continued)

FOREIGN PATENT DOCUMENTS

JP H11281098 10/1999
JP H11294365 A * 10/1999

(Continued)

OTHER PUBLICATIONS

Nicklas Engstrom, Inclination angle of noise barriers, 2011, The Marcus Wallenberg Lab, p. 27 (Year: 2011).*

(Continued)

*Primary Examiner* — Jenna M Hopkins
(74) *Attorney, Agent, or Firm* — Fish & Richardson P.C.

(57) ABSTRACT

A cover for a compressor defines an accommodating space configured to receive the compressor. The cover includes a first cover that is configured to be spaced apart from an outer surface of the compressor and that define a first portion of the accommodating space, and a second cover that is detachably attached to the first cover and configured to be spaced apart from the outer surface of the compressor and that defines a second portion of the accommodating space. The first cover and the second cover are configured to reduce transmission of noise generated from the compressor to an outside of the accommodating space.

17 Claims, 9 Drawing Sheets

(56) References Cited

U.S. PATENT DOCUMENTS

| | | | | | |
|---|---|---|---|---|---|
| 5,997,258 | A * | 12/1999 | Sawyer, III | F04B 39/0044 417/902 |
| 6,062,033 | A * | 5/2000 | Choi | F04B 39/0033 62/296 |
| 6,558,248 | B1 * | 5/2003 | Moore, Jr. | F24F 13/084 454/289 |
| 9,413,204 | B2 * | 8/2016 | Ota | F04B 17/03 |
| 9,777,944 | B2 * | 10/2017 | Mehta | F24F 13/24 |
| 2013/0115122 | A1 * | 5/2013 | Lee | F01C 21/10 418/55.1 |
| 2020/0040891 | A1 * | 2/2020 | Nalini | F04C 23/008 |

FOREIGN PATENT DOCUMENTS

| | | | | |
|---|---|---|---|---|
| JP | 2006110223 | | 4/2006 | |
| JP | 2009014228 | A * | 1/2009 | F04B 39/0033 |
| JP | 2011179709 | | 9/2011 | |
| JP | 2016183572 | | 10/2016 | |
| KR | 2019950014990 | | 6/1995 | |
| KR | 2019990016603 | | 5/1999 | |
| KR | 19990058727 | | 7/1999 | |
| KR | 20030042348 | | 5/2003 | |
| KR | 10-0749656 | | 8/2007 | |
| KR | 20120090161 | A * | 8/2012 | |
| KR | 1020120090161 | | 8/2012 | |
| KR | 20140100044 | | 8/2014 | |
| KR | 101838077 | | 3/2018 | |
| KR | 102217013 | B1 * | 2/2021 | |
| WO | WO2009004766 | | 1/2009 | |
| WO | WO-2009004766 | A1 * | 1/2009 | F04B 39/0033 |
| WO | WO2018116421 | | 6/2018 | |

OTHER PUBLICATIONS

WO2009004766A1 English machine translation (Year: 2009).*
KR20120090161A English machine translation (Year: 2012).*
JPH11294365A English machine translation (Year: 1999).*
Extended European Search Report in European Appln. No. 19210511.2, dated Jun. 22, 2020, 10 pages.
Korean Office Action in Korean Application No. 10-2019-0013517 dated Oct. 20, 2020, 9 pages (with English translation).

* cited by examiner

SOUNDPROOF COVER OF A COMPRESSOR

CROSS-REFERENCE TO RELATED APPLICATIONS

This application claims the benefit of Korean Patent Application No. 10-2019-0013517, filed on Feb. 1, 2019, which is hereby incorporated by reference as if fully set forth herein.

TECHNICAL FIELD

The present disclosure relates to a cover of a compressor, and more particularly, to a soundproof cover of a compressor for attenuating noise generated during compression of refrigerant in the compressor.

BACKGROUND

An air conditioner is an apparatus that can cool, heat, or purify air in an indoor space. For example, the air conditioner may perform a cycle to transfer heat by circulating refrigerant through compression, condensation, expansion, and evaporation in this order.

In some examples, the air conditioner may include a compressor as a device for compressing the refrigerant. The compressor may be arranged inside an outdoor unit of the air conditioner. Compressors may be divided into rotary compressors, scroll compressors, centrifugal compressors, and the like depending on the compression techniques.

While a compressor is an essential constituent of an air conditioner, the compressor may generate noise in a process of compressing refrigerant when the compressor is driven. More specifically, noise may be classified into noise generated when the compressor compresses the refrigerant, and a structural noise caused by the excitation force of the compressor.

In some cases, the compressor may be covered with a noise-blocking cover that surrounds the compressor in order to attenuate the noise of the compressor. The noise-blocking cover may be made of materials for blocking or absorbing the noise.

In some examples, a low-noise outdoor unit may include a first sound absorbing member provided to a scroll compressor, which compresses a refrigerant at a high temperature and a high pressure, to absorb noise generated in the compressor, and a cover for protecting the compressor and the first sound absorbing member.

The first sound absorbing member may be attached to the compressor to absorb noise generated in the compressor, the cover may be arranged to surround the first sound absorbing member and the compressor, and a second sound absorbing member may be coupled to an inner surface of the cover.

In some cases, vibration generated during operation of the compressor causes friction against the sound absorbing member may cause friction noise. In such cases, the sound absorbing member may be heated, and the sound absorbing performance may be deteriorated.

In some cases, where the cover is integrally formed to surround the compressor, vibration generated during operation of the compressor may not be effectively canceled. As a result, structural noise may be generated by the vibration.

In some cases, the conventional noise-blocking cover may include a Velcro material on one surface and the other surface thereof, and may be arranged to surround the outer peripheral surface of the compressor such that both ends thereof contact each other and are then fixed through the Velcro material.

In some cases, both ends of the noise-blocking cover may be fixed by the Velcro material and be in contact with each other. In some cases, when a gap between the ends is gradually widened by vibration of the compressor, noise may leak through the gap.

In some cases, where both ends of the noise-blocking cover are arranged to overlap each other, a gap may be created in a portion of the noise-blocking cover that is placed on the top of the compressor, and noise may leak through the gap.

SUMMARY

The present disclosure describes a soundproof cover of a compressor.

The present disclosure describes a soundproof cover to prevent leakage of noise generated in a compressor and to prevent structural noise caused by vibration of the compressor.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

According to one aspect of the subject matter described in this application, a cover for a compressor defines an accommodating space configured to receive the compressor. The cover includes a first cover that is configured to be spaced apart from an outer surface of the compressor and that define a first portion of the accommodating space, and a second cover that is detachably attached to the first cover and configured to be spaced apart from the outer surface of the compressor and that defines a second portion of the accommodating space. The first cover and the second cover are configured to reduce transmission of noise generated from the compressor to an outside of the accommodating space.

Implementations according to this aspect may include one or more of the following features. For example, the cover may further include a connection part that is disposed between the first cover and the second cover and that is configured to connect the first cover and the second cover to each other. In some examples, the connection part may be made of a magnetic material. In some examples, one of the first cover or the second cover is configured to accommodate a compression unit of the compressor, where the compression unit is configured to compress refrigerant, and the other of the first cover or the second cover may be configured to accommodate a drive unit of the compressor, the drive unit being configured to drive the compression unit. The first cover and the second cover may be made of different materials.

In some implementations, the one of the first cover or the second cover configured to accommodate the compression unit may include a plurality of plates that are stacked in a direction from an inside of the accommodating space to the outside of the accommodating space. In some examples, the plurality of plates may include: a first plate that defines an inner surface of the cover facing the accommodating space, the first plate defining a plurality of holes configured to reduce transmission of the noise; a second plate stacked on the first plate and configured to absorb the noise; and a third plate that is stacked on the second plate, that defines an outer surface of the cover, and that is configured to reduce transmission of the noise.

In another aspect of the subject matter, a cover for a compressor defines an accommodating space configured to receive the compressor, and the cover includes: a first cover that extends along a longitudinal direction of the compressor from a perimeter of a first surface of the first cover and that defines a first portion of the accommodating space configured to receive a first end of the compressor; a second cover that is detachably attached to the first cover and spaced apart from an outer surface of the compressor and that defines a second portion of the accommodating space; and a third cover that is detachably attached to the second cover, that extends along the longitudinal direction of the compressor from a perimeter of a first surface of the third cover, and that defines a third portion of the accommodating space configured to receive a second end of the compressor opposite to the first end. The first cover, the second cover, and the third cover are configured to reduce transmission of noise generated from the compressor to an outside of the accommodating space.

Implementations according to this aspect may include one or more of the following features. For example, the first cover, the second cover, and the third cover may be configured to cover a plurality of components of the compressor. The components may include: a cabinet that includes an inlet portion disposed at a first side of the cabinet and configured to introduce refrigerant and a discharge portion disposed at the first side of the cabinet and configured to discharge the refrigerant; a drive unit coupled to an inner circumferential surface of the cabinet; a rotary shaft that extends from the drive unit in a direction away from the discharge portion and that is configured to rotate; a compression unit coupled to the rotary shaft and configured to compress the refrigerant; and a fixing portion configured to fix the compressor to a ground.

In some examples, the first surface of the first cover may define a communication hole configured to receive the inlet portion or the discharge portion, and the inlet portion or the discharge portion may be configured to penetrate the communication hole. In some examples, the second cover may extend in the longitudinal direction to cover the compression unit having a first height and the driving unit having a second height. In some examples, the first surface of the third cover may define an opening configured to receive the cabinet, and the cabinet may be configured to penetrate the opening.

In some implementations, the first surface of the first cover may define a communication hole configured to receive the inlet portion and an opening configured to receive the cabinet. The inlet portion may be configured to penetrate the communication hole, and the the cabinet may be configured to penetrate the opening. In some examples, the second cover may extends along the longitudinal direction to cover the compression unit having a first height. In some examples, the first surface of the third cover may define a coupling hole at a position corresponding to a fixing hole defined by the fixing portion, and the coupling hole may be configured to receive a screw passing through the fixing hole.

In some implementations, the cover may further include: a first connection part disposed between the first cover and the second cover and configured to connect the first cover and the second cover to each other; and a second connection part disposed between the second cover and the third cover and configured to connect the second cover and the third cover to each other. In some examples, the first connection part and the second connection part may be made of a magnetic material. In some examples, the second cover and the third cover may be made of different materials.

In some implementations, the second cover may include a plurality of plates that are stacked in a direction from an inside of the accommodating space to the outside of the accommodating space. In some examples, the plurality of plates may include: a first plate that defines an inner surface of the cover facing the accommodating space and that defines a plurality of holes configured to reduce transmission of the noise; a second plate stacked on the first plate and configured to absorb the noise; and a third plate that is stacked on the second plate, that defines an outer surface of the cover, and that is configured to reduce transmission of the noise.

In some implementations, the first surface of the first cover may define a predetermined inclination angle with respect to a plane parallel to the first surface of the third cover.

In some implementations, the compressor may include a plurality of covers separable from each other, each of which may be made of a material capable of effectively blocking radiated noise and structural noise of the compressor. The compressor may include a magnetic connection part for connecting the covers. Accordingly, leakage of noise from the soundproof cover may be effectively prevented.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate implementation(s) of the disclosure and together with the description serve to explain the principle of the disclosure.

DETAILED DESCRIPTION

Figure 1:
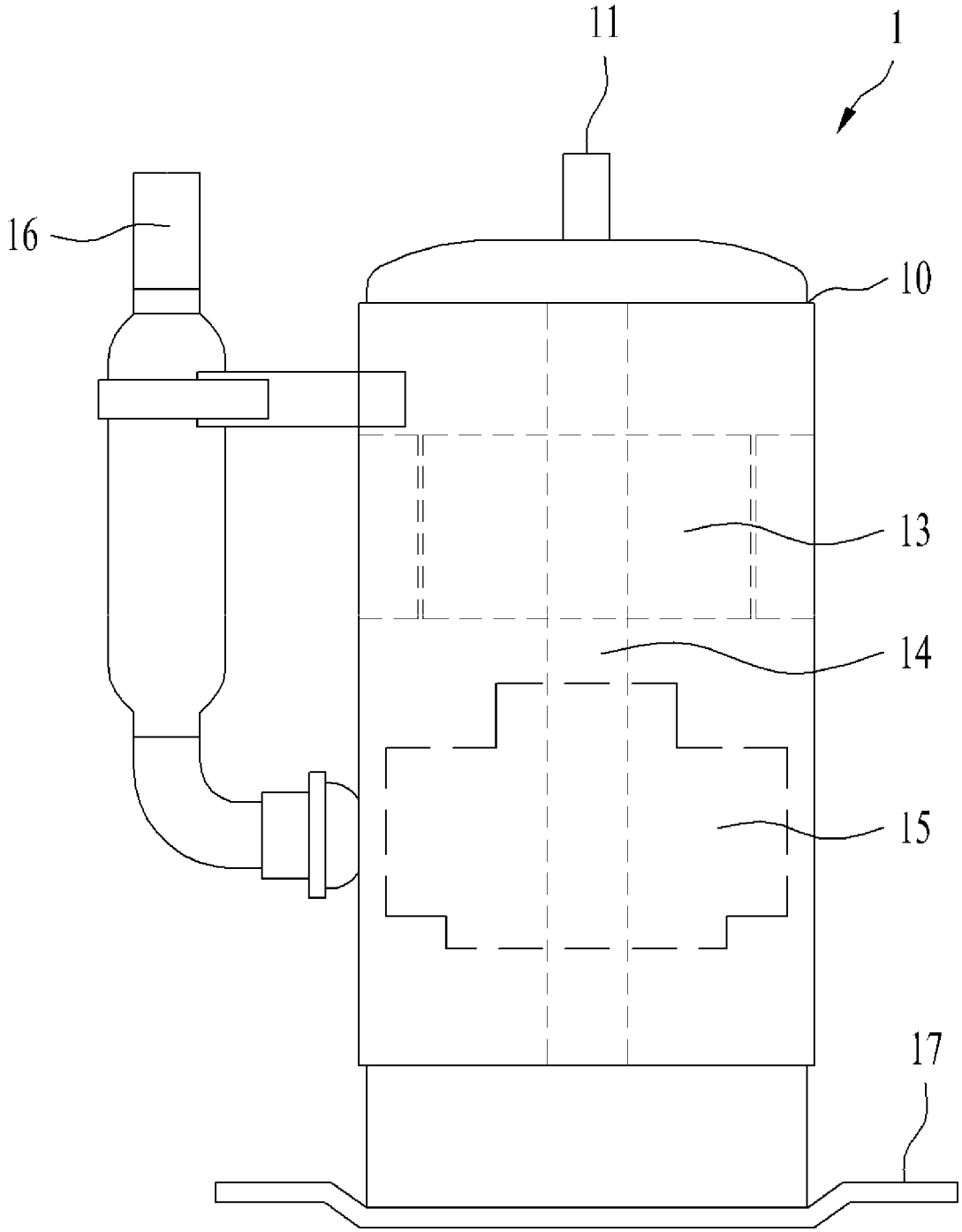
FIG. 1 is a view illustrating a configuration of an example compressor.

Reference will now be made in detail to one or more implementations of the present disclosure, examples of which are illustrated in the accompanying drawings. Wherever possible, the same reference numbers will be used throughout the drawings to refer to the same or like parts.

The sizes and shapes of the components shown in the drawings may be exaggerated for clarity and brevity. In some cases, the sizes and shapes may be drawn to scale to illustrate relative sizes of the components. In addition, terms defined in consideration of the configuration and operation of the present disclosure may be changed depending on the intention of a user or an operator, or custom.

Definitions of such terms should be based on the content of this specification.

FIG. 1 is a view illustrating a configuration of an example compressor.

Referring to FIG. 1, a compressor 1 may include or form a cabinet 10, a discharge portion 11, a drive unit 13, a rotary shaft 14, a compression unit 15, an inlet portion 16, and a fixing portion 17.

In some examples, the compressor 1 may include a cabinet 10 defining a space where a fluid is stored or moved, a discharge portion 11 disposed at the cabinet 10 to allow a refrigerant to be discharged therethrough, and an inlet portion 16 connected to a side of the cabinet 10 such that a low-pressure refrigerant is introduced thereinto. Thus, the refrigerant is introduced and discharged through the compressor 1.

The drive unit 13 may be coupled to the inner circumferential surface of the cabinet 10 and configured to transmit rotational force to the rotary shaft 14. For example, the drive unit 13 may be provided in the cabinet 10 and arranged below at the discharge portion 11.

In some implementations, the drive unit 13 may include a stator configured to generate a rotating magnetic field and a rotator configured to be rotated by the rotating magnetic field. The rotary shaft 14 may be coupled to the rotator to rotate together with the rotator. The stator has a plurality of slots formed in the inner circumferential surface thereof in a circumferential direction such that a coil is wound on the stator, and the rotator is coupled with permanent magnets to generate rotational power within the stator.

In some examples, the drive unit 13 may include elements capable of performing uniaxial rotation using a rotating magnetic field.

The compression unit 15 may be one of a reciprocating type, a rotary type, a scroll type, or the like according to techniques for compressing the refrigerant introduced into the inlet portion 16. For example, the compression unit 15 may be a scroll compression unit in which an orbiting scroll is engaged with a fixed scroll to perform the orbiting motion.

The compression unit 15 may be arranged under the drive unit 13. Thus, in the cabinet 10, the drive unit 13 may be arranged under the discharge portion 11, and compression unit 15 is arranged under the drive unit 13.

The rotary shaft 14 may extend from the drive unit 13 in a direction away from the discharge portion 11 to rotate. In addition, one end of the rotary shaft 14 may be connected to the drive unit 13 and the other end of the rotary shaft 14 may be supported by the compression unit 15.

The fixing portion 17 may be arranged under the cabinet 10 to fix the compressor 1 to the ground and may have an area larger than a bottom area of the cabinet 10.

Figure 2:
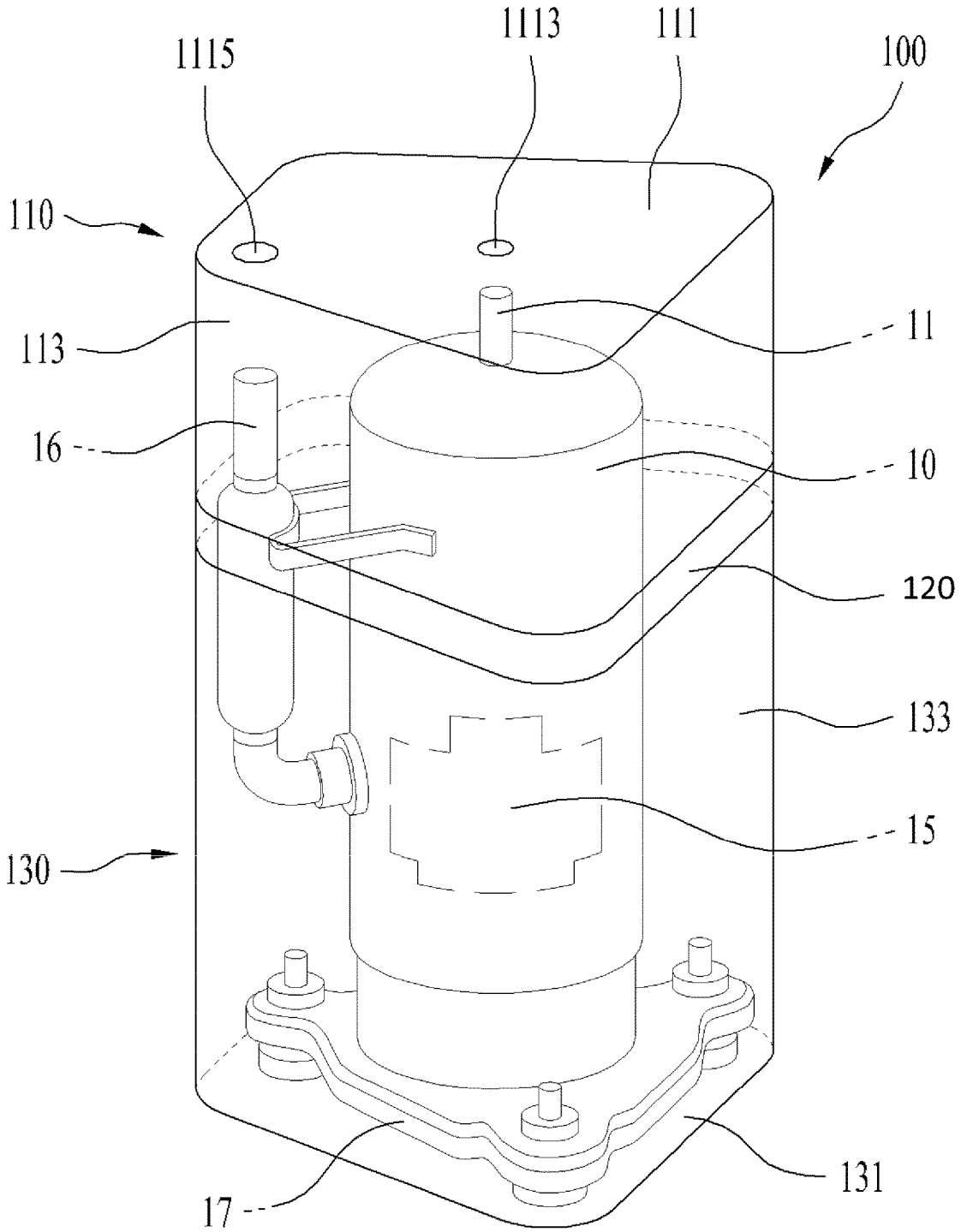
FIG. 2 is a view illustrating an example soundproof cover.
Figure 3:
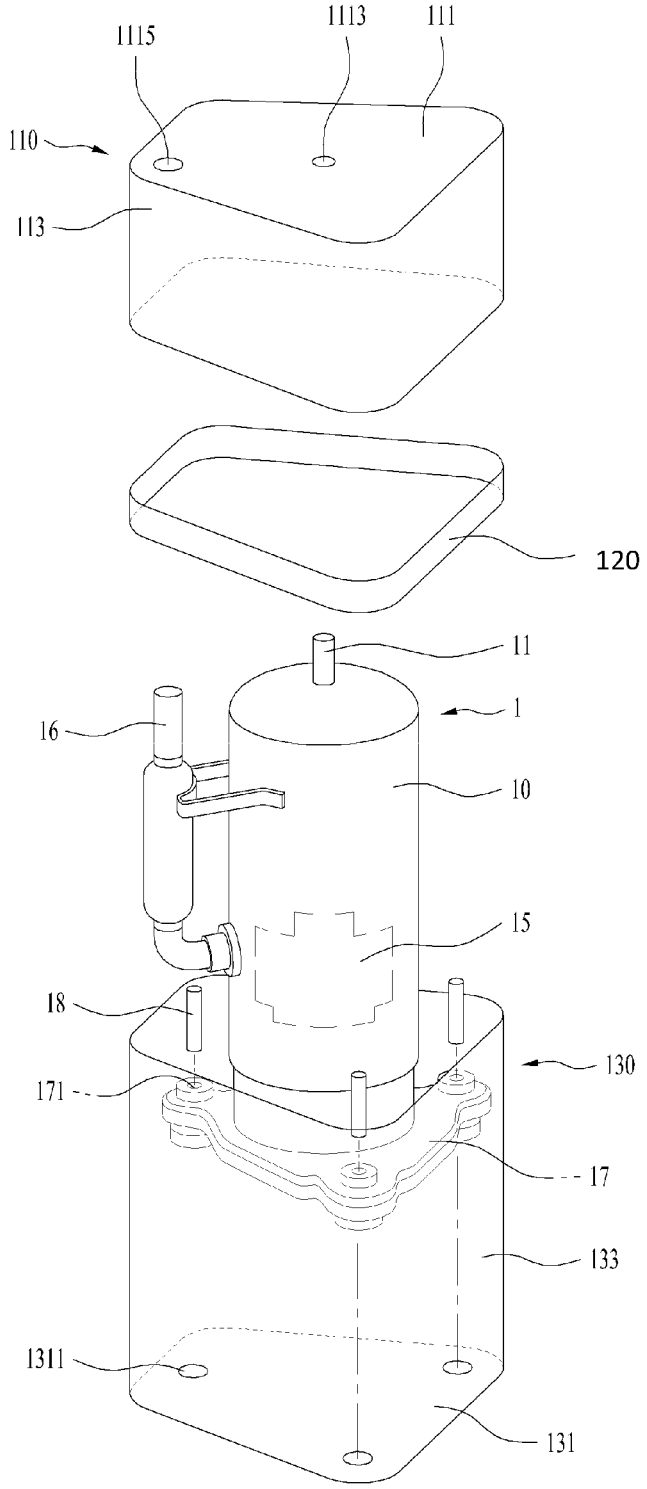
FIG. 3 is an exploded view of the soundproof cover of FIG. 2.
Figure 4:
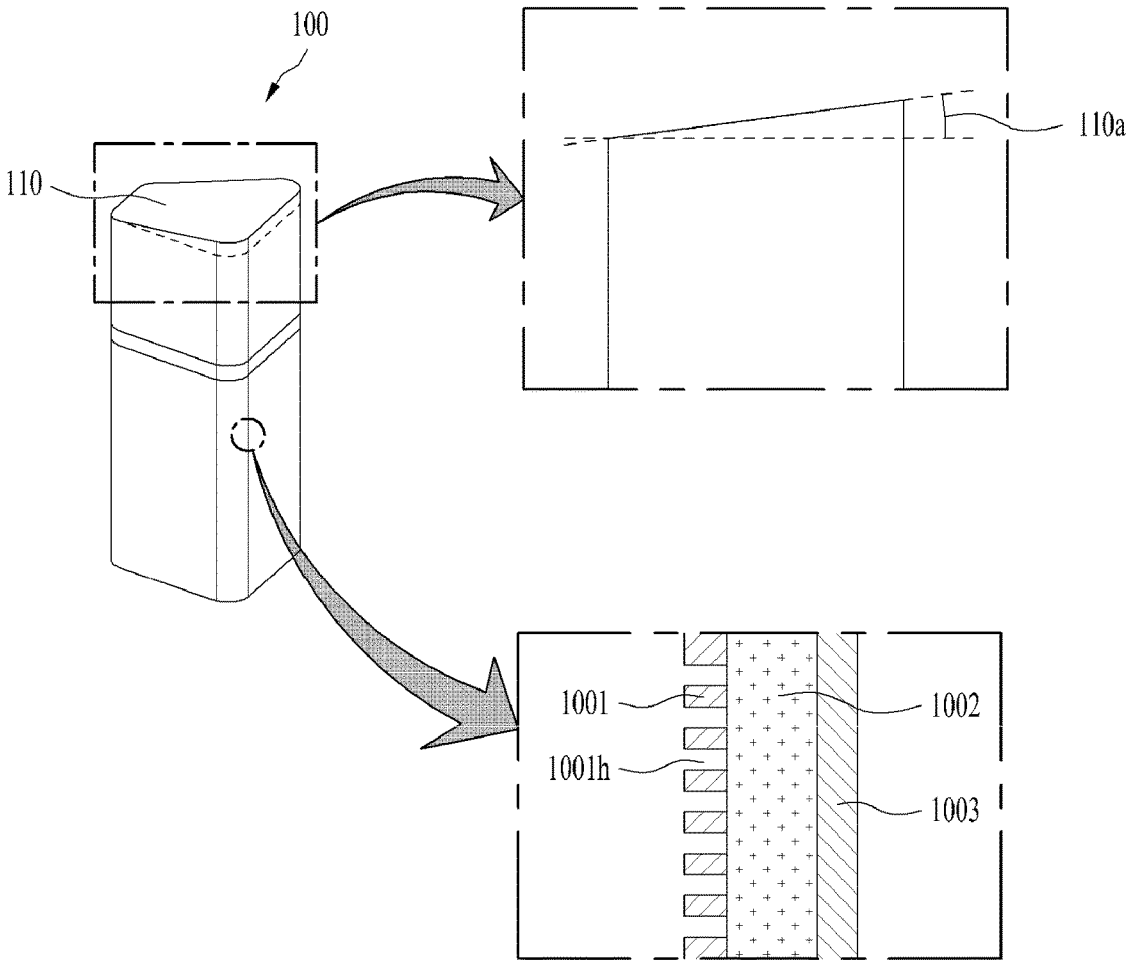
FIG. 4 is a view showing an example exterior and an example cross section of the soundproof cover of FIG. 2.

FIG. 2 is a view illustrating an example soundproof cover accommodating a compressor, FIG. 3 is an exploded view of the soundproof cover of FIG. 2, and FIG. 4 is a view showing the exterior and the cross section of the soundproof cover of FIG. 2.

Referring to FIGS. 2 to 4, a soundproof cover 100 may define an accommodating space configured to receive the compressor 1 and be configured to block at least some of the noise from being transmitted to the outside of the accommodating space. The soundproof cover 100 may include a first cover 110 spaced apart an outer surface of the compressor 1 to accommodate the compressor 1, and a second cover 130 arranged so as to be detachably attached to the first cover 110 and spaced apart from the outer surface of the compressor 1 to accommodate the compressor 1.

The first cover 110 and the second cover 130 may accommodate the compressor 1. For example, the accommodating space may entirely accommodate an entire portion of the compressor 1. In some cases, a part of the compressor 1 may protrude outside the accommodating space. In some examples, the accommodating space may accommodate any portion of the compressor 1 in a predetermined space. For example, the first cover 110 may define a first portion of the accommodating space and accommodate a first part of the compressor 1, and the second cover 130 may define a second portion of the accommodating space and accommodate a second part of the compressor 1. In some cases, the first portion and the second portion define the entire accommodating space.

In addition, the soundproof cover 100 may define a space capable of surrounding and accommodating the compressor 1 so as to perform sound absorption or sound insulation of noise generated in the compressor 1.

For example, in order to absorb radiated noise generated in the process of compressing the refrigerant, for example, noise generated around the compression unit 15, the soundproof cover 100 may be arranged spaced apart from an outer surface of the compressor 1 including the compression unit 15. Thereby, a space for accommodating only a part of the compressor 1 may be formed.

The first cover 110 and the second cover 130 may be arranged so as to be detachably attached to each other. The first cover 110 and the second cover 130 may be arranged so as to be detachably attached by a connection part 120.

The first cover 110 may have a side surface 113 extending in a longitudinal direction of the compressor 1 along a perimeter of the surface 111 to accommodate one end of the compressor 1. The second cover 130 may have a side surface 133 extending in the longitudinal direction of the compressor 1 along a perimeter of the surface 131 to accommodate an opposite end of the compressor 1.

The surface 111 of the first cover 110 may be positioned over the discharge portion 11 and the inlet portion 16 of the compressor 1, and the first cover 110 may define a plurality of communication holes 1113 and 1115 at positions corresponding to the discharge portion 11 and the inlet portion 16, respectively.

The side surface 113 of the first cover 110 may extend from above the compressor 1 to a lower side of the compressor 1 along a perimeter of the surface 111, and be arranged spaced apart from the outer surface of the compressor 1 to accommodate the compressor 1.

The surface 131 of the second cover 130 may be positioned under the fixing portion 17 of the compressor 1, and the fixing portion 17 may be provided with fixing holes 171 for fixing the compressor 1 to the ground. The surface 131 of the second cover 130 may be provided with holes 1311 at positions corresponding to the fixing holes 171.

As the fixing holes 171 of the fixing portion 17 and the holes 1311 of the second cover 130 are provided at positions corresponding to each other, the compressor 1 may be fixed to the ground by arranging screws 18 through the fixing holes 171 and the holes 1311 in a penetrating manner.

The side surface 133 of the second cover 130 may extend from the bottom of the compressor 1 to an upper side of the compressor 1 along a perimeter of the surface 131 and be arranged spaced apart from the outer surface of the compressor 1 to accommodate the compressor 1.

That is, as the first cover 110 and the second cover 130 are arranged so as to be detachably attached to each other, the soundproof cover 100 may define a space for accommodating the compressor 1.

The first cover 110 and the second cover 130 may be detachably attached by the connection part 120. The connection part 120 may be arranged between the first cover 110 and the second cover 130 to connect the first cover 110 to the second cover 130, and may be made of a magnetic material.

As the connection part 120 is made of a magnetic material, the first cover 110 and the second cover 130 may be detachably attached by the magnetism. The connection part 120 may be provided to at least one of the first cover 110 and the second cover 130 such that the first cover 110 and the second cover 130 are detachably attached to each other. Alternatively, the connection part 120 may be separately arranged between the first cover 110 and the second cover 130 such that the first cover 110 and the second cover 130 can be detachably arranged.

As the first cover 110 and the second cover 130 are detachably arranged, mass productivity and assemblability of the soundproof cover 100 may be improved, and the noise generated in the compressor 1 may be effectively blocked.

In some implementations, where the second cover 130 defines a space for accommodating the compression unit 15 of the compressor 1, the second cover 130 may be made of a material for effectively blocking the radiated noise generated in the compressor 1.

Since the first cover 110 and the second cover 130 are connected to each other with the connection part 120 interposed therebetween, vibration of the compressor 1 caused due to the contact between the second cover 130 and the lower surface of the compressor 1 may be absorbed, and structural noise generated by vibration of the compressor 1 may be prevented from being transmitted to the outside of the soundproof cover 100.

The structure capable of absorbing the vibration generated in the compressor 1 may be realized by material properties of an element constituting the first cover 110 or the second cover 130. However, as the first cover 110 and the second cover 130 are detachably arranged with the connection part 120 interposed therebetween, vibration may be prevented from being transmitted to the entirety of the soundproof cover 100. Thereby, the structural noise occurring in the compressor 1 may be effectively prevented from being transmitted to the outside of the soundproof cover 100.

Referring to FIG. 4, one surface 111 of the first cover 110 may form a predetermined inclination angle 110*a* with respect to a plane parallel to one surface 131 of the second cover 130. The inclination angle 110*a* may be understood as an inclination angle between the ground on which the compressor 1 is arranged and the surface 111 of the first cover 110. As the inclination angle 110*a* is formed on the surface 111 of the first cover 110, the top and bottom surfaces of the soundproof cover 100 may be non-parallel with each other.

As the inclination angle 110*a* is formed, radiated noises generated in the compressor 1 may be mutually cancelled inside the soundproof cover 100, and thus noise may be more effectively prevented from being transmitted to the outside of the soundproof cover 100.

One of the first cover 110 and the second cover 130 that accommodates the compressor 1 including the compression unit 15 may have at least two plates stacked from the inside of the accommodating space to the outside of the accommodating space.

In this implementation, the second cover 130 defines a space for accommodating the compressor 1 including the compression unit 15. Accordingly, the second cover 130 may form a structure in which the two or more plates are stacked.

The structure in which the two or more plates are stacked may be formed on the side surface 133 of the second cover 130. However, the structure in which the two or more plates are stacked is not necessarily formed only on the side surface 133. For example, the structure in which two or more plates are stacked may also be formed on one surface 131 of the second cover 130.

The plates may include a first plate 1001, a second plate 1002 and a third plate 1003, which are stacked from the inner surface of the soundproof cover 100 defining the accommodating space to the outside of the soundproof cover 100.

The first plate 1001 defines the inner surface of the accommodating space. As the first plate 1001, a porous sound insulating member provided with a plurality of holes 1001*h* to insulate noise may be adopted. The second plate 1002 may be stacked on the first plate 1001. As the second plate 1002, a sound absorbing member for absorbing the noise may be adopted. The third plate 1003 may be stacked on the second plate 1002 to define the outer surface of the soundproof cover 100. As the third plate 1003, a sound insulating member for isolating the noise may be adopted.

The first plate 1001 may be arranged at a position which the noise generated in the compressor 1 reaches first, and the plurality of holes 1001*h* may increase the sound absorption rate for a specific frequency band (1000 Hz or less). A resonator structure may be formed as the size of the holes 1001*h* formed by perforating the first plate 1001 decreases. Accordingly, the size of the holes may be adjusted according to the frequency band to be insulated.

The sound absorbing member adopted as a constituent of the second plate 1002 refers to various materials having sound absorbing performance, such as a porous sound absorbing member and a plate sound absorbing member depending on the structure thereof. For example, the porous sound absorbing member has small bubble or thin tube-shaped holes in the surface and inside thereof, and causes sound energy to be converted into heat energy and absorbed due to friction occurring when the air inside the holes is vibrated by sound waves. The plate sound absorbing member consumes the sound energy as sound waves vibrate the plate.

The first plate 1001 and the third plate 1003 may be identified based on whether the holes 1001*h* are formed in the sound insulating member. When the first plate 1001 and the third plate 1003 are made of the same material, the manufacturing process of the soundproof cover 100 may be simplified and the cost reduction may be realized. However, implementations are not limited thereto. The first plate 1001, the second plate 1002, and the third plate 1003 may be formed of different materials as a porous sound insulating member is adopted as the first plate 1001, a sound absorbing member is adopted as the second plate 1002, and a sound insulating member is adopted as the third plate 1003.

Figure 5:
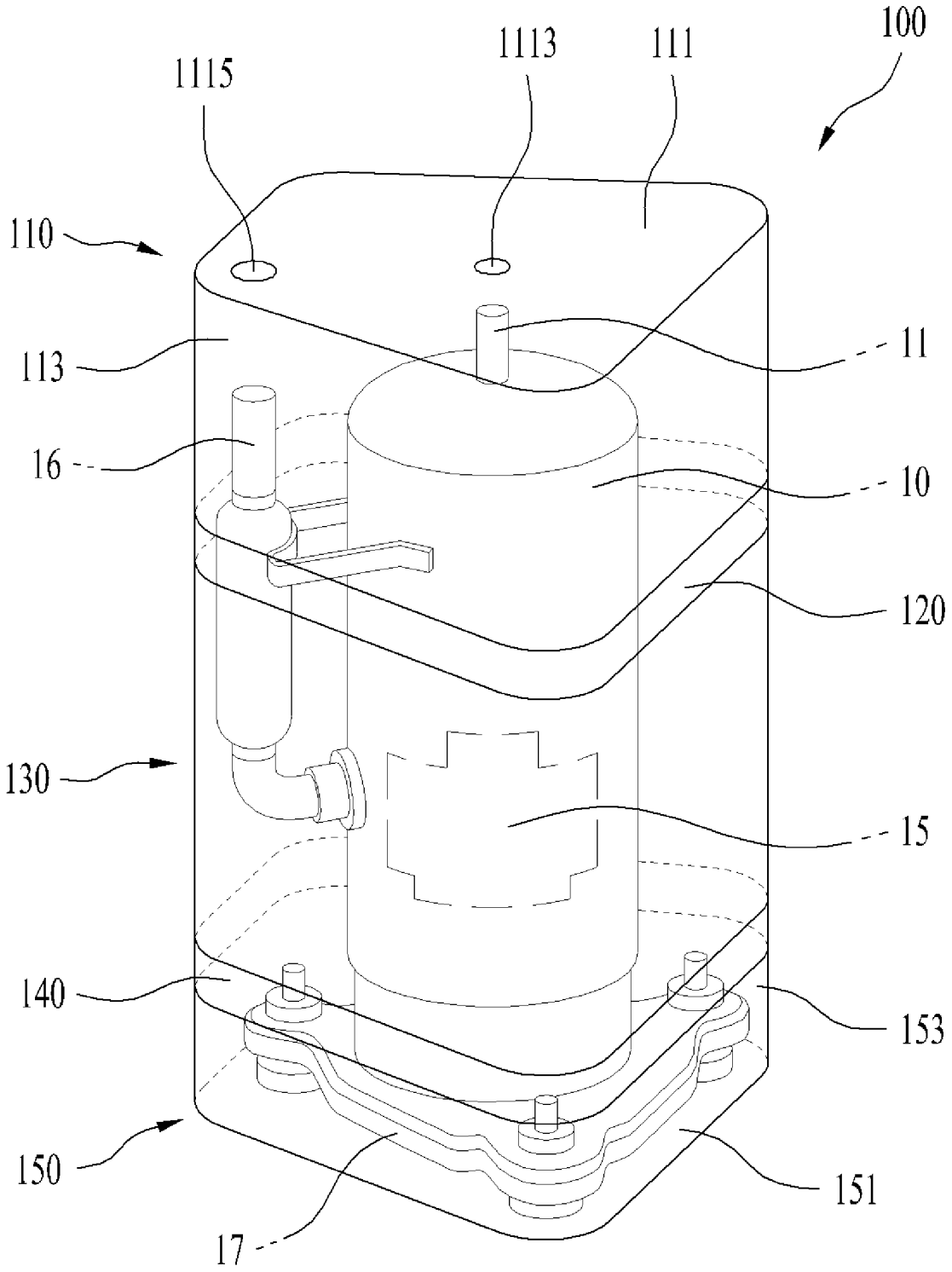
FIG. 5 is a view showing an example soundproof cover accommodating a compressor.
Figure 6:
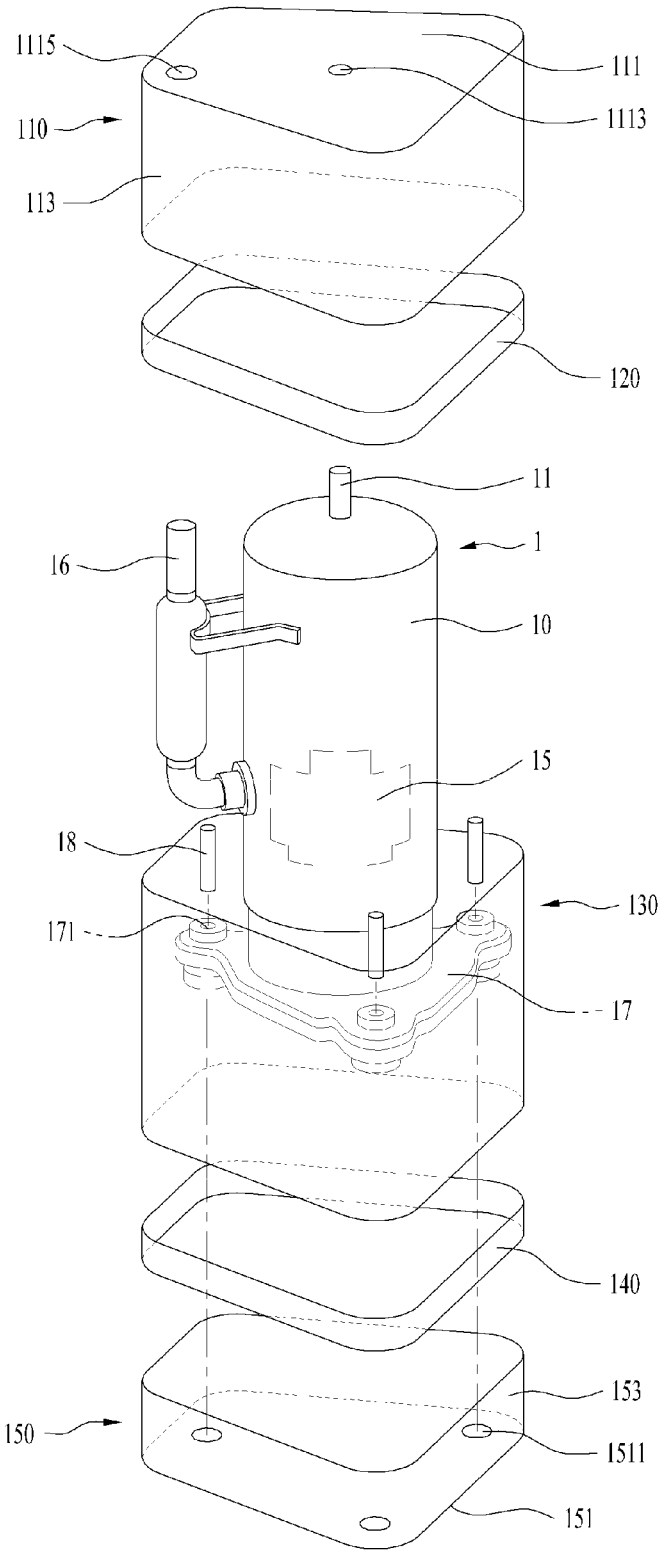
FIG. 6 is an exploded view showing the soundproof cover of FIG. 5.
Figure 7:
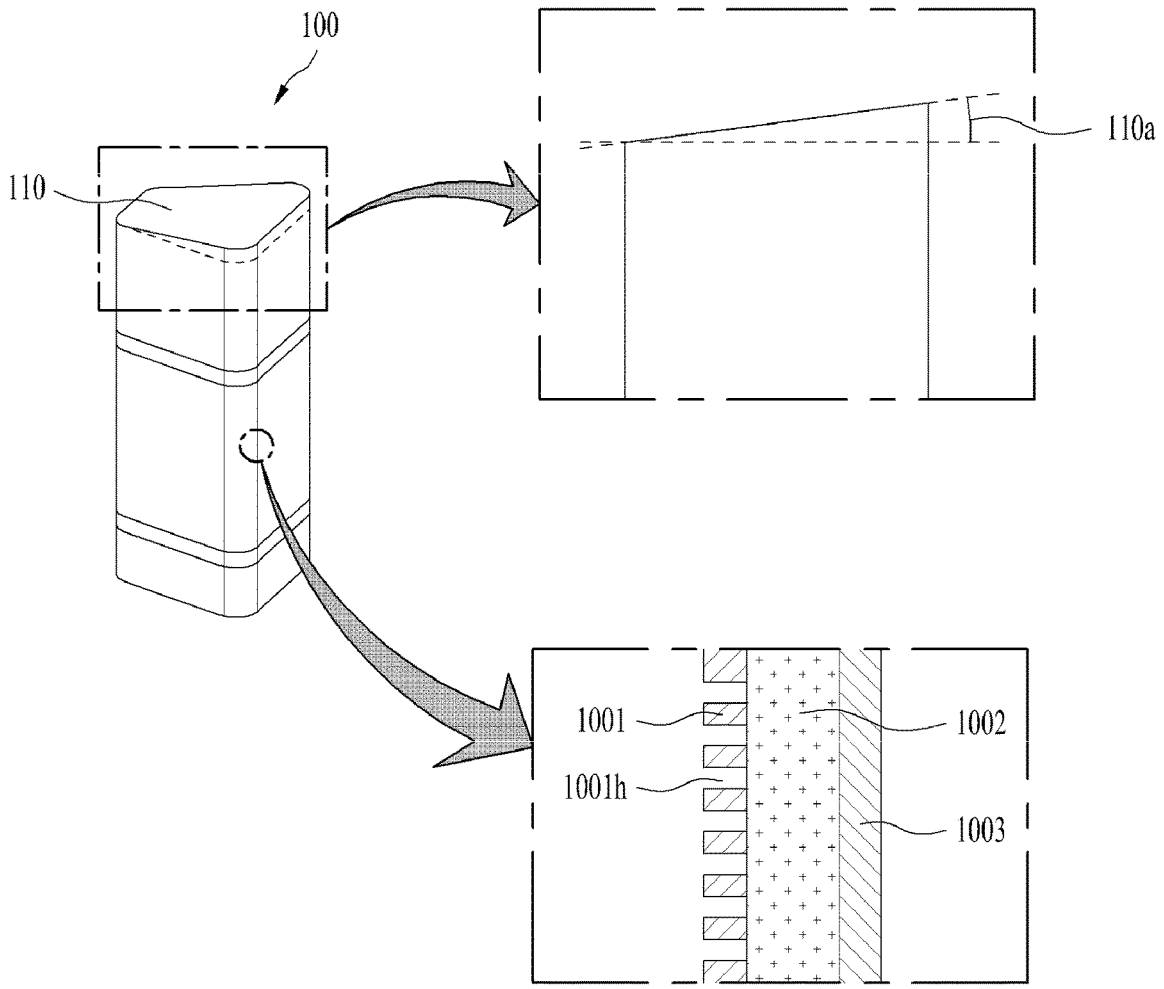
FIG. 7 is a view showing an example exterior and an example cross section of the soundproof cover of FIG. 5.

FIG. 5 is a view showing an example soundproof cover accommodating a compressor, FIG. 6 is an exploded view of the soundproof cover of FIG. 5, and FIG. 7 is a view showing the exterior and the cross section of the soundproof cover of FIG. 5.

Referring to FIGS. 5 to 7, a soundproof cover 100 may include a first cover 110, a second cover 130, and a third cover 150, and also include a first connection part 120 and a second connection part 140 for connecting the covers.

The first cover 110 may extend in a longitudinal direction of the compressor 1 along a perimeter of one surface 111 to accommodate one end of the compressor 1, and the second cover 130 may be arranged so as to be detachably attached to the first cover 110 and be spaced apart from the outer surface of the compressor 1 to accommodate the compressor 1. The third cover 150 may be arranged so as to be detachably attached to the second cover 130 and extend in the longitudinal direction of the compressor 1 along a perimeter of one surface 151 to accommodate an opposite end of the compressor 1.

The surface 111 of the first cover 110 may be positioned over the discharge portion 11 and the inlet portion 16 of the compressor 1, and the first cover 110 may define communication holes 1113 and 1115 at positions corresponding to the discharge portion 11 and the inlet portion 16, respectively.

The side surface 113 of the first cover 110 may extend from above the compressor 1 to a lower side of the compressor 1 along a perimeter of the surface 111 and be arranged spaced apart from the outer surface of one end of the compressor 1 to accommodate the compressor 1.

The second cover 130 may be arranged so as to be detachably attached to the first cover 110. The second cover 130 may be spaced apart from the outer surface of the compressor 1 and extend along the longitudinal direction of the compressor 1 to accommodate the compressor 1. The longitudinal direction of the compressor 1 refers to the longitudinal height of the compressor 1.

The surface 151 of the third cover 150 may be positioned under the fixing portion 17 of the compressor 1, and the fixing portion 17 may be provided with fixing holes 171 for fixing the compressor 1 to the ground. The surface 151 of the third cover 150 may be provided with holes 1511 at positions corresponding to the fixing holes 171.

As the fixing holes 171 of the fixing portion 17 and the holes 1511 of the third cover 150 are provided at positions corresponding to each other, the compressor 1 may be fixed to the ground by arranging screws 18 through the fixing holes 171 and the holes 1511 in a penetrating manner.

The side surface 153 of the third cover 150 may extend from the bottom of the compressor 1 to an upper side of the compressor 1 along a perimeter of the surface 151 and be arranged spaced apart from the outer surface of the opposite end of the compressor to accommodate the compressor 1.

That is, as the first cover 110, the second cover 130, and the third cover 150 are arranged so as to be detachably attached to each other, the soundproof cover 100 may define a space for accommodating the compressor 1.

The first cover 110 and the second cover 130 may be detachably attached by the first connection part 120. The first connection part 120 may be arranged between the first cover 110 and the second cover 130 to connect the first cover 110 to the second cover 130 and be made of a magnetic material.

As the first connection part 120 is made of a magnetic material, the first cover 110 and the second cover 130 may be detachably attached by the magnetism. The first connection part 120 may be provided to at least one of the first cover 110 and the second cover 130 such that the first cover 110 and the second cover 130 are detachably attached to each other. Alternatively, the first connection part 120 may be separately arranged between the first cover 110 and the second cover 130 such that the first cover 110 and the second cover 130 are detachably attached to each other.

In addition, the second cover 130 and the third cover 150 may be detachably attached by the second connection part 140. The second connection part 140 may be arranged between the second cover 130 and the third cover 150 to connect the second cover 130 and the third cover 150 and be made of a magnetic material As the second connection part 140 is made of a magnetic material, the second cover 130 and the third cover 150 may be detachably attached by the magnetism. The second connection part 140 may be provided to at least one of the second cover 130 and the third cover 150 such that the second cover 130 and the third cover 150 are detachably attached to each other. Alternatively, the second connection part 140 may be separately arranged between the second cover 130 and the third cover 150 such that the second cover 130 and the third cover 150 are detachably attached to each other.

As the first cover 110, the second cover 130, and the third cover 150 are arranged in three stages so as to be detachably attached to each other, mass productivity and assemblability of the soundproof cover 100 may be improved, and the noise generated in the compressor 1 may be effectively blocked.

In some implementations, the soundproof cover 100 may include the first cover 110, the second cover 130, and the third cover 150, which are arranged in three stages so as to be detachably attached to each other. The second cover 130 may surround the side surface of the compressor 1 and may be made of a sound insulating material, a sound absorbing material, or the like to prevent radiated noise generated in the drive unit 13 or the compression unit 15 from being transmitted to the outside. The third cover 150 may surround the lower side of the compressor 1 and may be made of a porous material, a cushioning material, or the like for absorbing vibration in order to minimize structural noise caused by vibration of the compressor 1. The first cover 110 may surround the upper side of the compressor 1 and may be made of various materials that prevent noise not insulated by the second cover 130 or the third cover 150 from being transmitted to the outside.

In some examples, the structure capable of absorbing the vibration generated in the compressor 1 may be realized by the material properties of the element constituting the third cover 150. However, as described above, since the first cover 110, the second cover 130 and the third cover 150 are detachably arranged with the connection parts 120 and 140 interposed therebetween, vibration may be prevented from being transmitted to the entirety of the soundproof cover 100. Accordingly, the structural noise generated in the compressor 1 may be effectively prevented from being transmitted to the outside of the soundproof cover 100.

Referring to FIG. 7, one surface 111 of the first cover 110 may form a predetermined inclination angle **110*a* with respect to a plane parallel to the surface 151 of the third cover 150. The inclination angle 110*a* may be understood as an inclination angle between the ground on which the compressor 1 is arranged and the surface 111 of the first cover 110. As the inclination angle 110*a* is formed on the surface 111 of the first cover 110, the top and bottom surfaces of the soundproof cover 100** may be non-parallel with each other.

As the inclination angle **110*a* is formed, radiated noises generated in the compressor 1 may be mutually cancelled inside the soundproof cover 100, and thus noise may be more effectively prevented from being transmitted to the outside of the soundproof cover 100**.

The second cover 130, which is a cover for accommodating the compressor 1 including the compression unit 15, may have at least two plates stacked from the inside of the accommodating space to the outside of the accommodating space.

The plates may include a first plate 1001, a second plate 1002 and a third plate 1003, which are stacked from the inner surface of the soundproof cover 100 defining the accommodating space to the outside of the soundproof cover 100.

The first plate 1001 defies an inner surface of the accommodating space. As the first plate 1001, a porous sound insulating member provided with a plurality of holes 1001*h* to insulate the noise may be adopted. The second plate 1002 may be stacked on the first plate 1001. As the second plate 1002, a sound absorbing member for absorbing the noise may be adopted. The third plate 1003 may be stacked on the second plate 1002 to define the outer surface of the soundproof cover 100. As the third plate 1003, a sound insulating member for isolating the noise may be adopted.

The first plate 1001 may be arranged at a position which the noise generated by the compressor 1 reaches first and the plurality of holes 1001*h* may increase the sound absorption rate for a specific frequency band (1000 Hz or less). A resonator structure may be formed as the size of the holes 1001*h* formed by perforating the first plate 1001 decreases. Accordingly, the size of the holes may be adjusted according to the frequency band to be insulated.

The sound absorbing member adopted as the element of the second plate 1002 refers to various materials having sound absorbing performance, such as a porous sound absorbing member and a plate sound absorbing member depending on the structure thereof. For example, the porous sound absorbing member has small bubble or thin tube-shaped holes in the surface and inside thereof, and causes sound energy to be converted into heat energy and absorbed due to friction occurring when the air inside the holes is vibrated by sound waves. The plate sound absorbing member consumes the sound energy as sound waves vibrate the plate.

The first plate 1001 and the third plate 1003 may be identified based on whether the holes 1001*h* are formed in the sound insulating member. When the first plate 1001 and the third plate 1003 are made of the same material, the manufacturing process of the soundproof cover 100 may be simplified and the cost reduction may be realized. However, implementations are not limited thereto. The first plate 1001, the second plate 1002, and the third plate 1003 may be formed of different materials as a porous sound insulating member is adopted as the first plate 1001, a sound absorbing member is adopted as the second plate 1002, and a sound insulating member is adopted as the third plate 1003.

Figure 8:
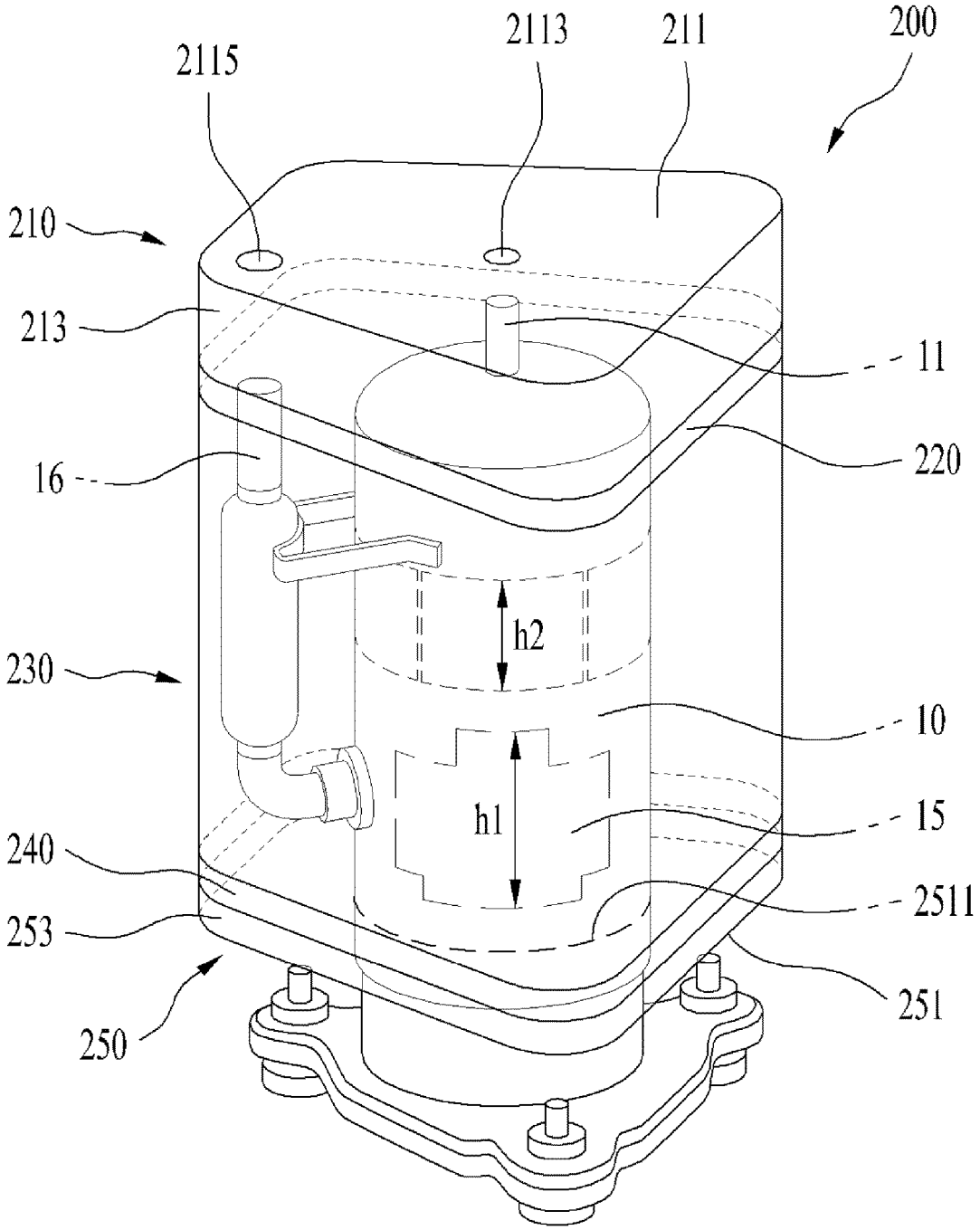
FIG. 8 is a view showing an example soundproof cover accommodating a compressor.

FIG. 8 is a view showing an example soundproof cover accommodating a compressor.

Referring to FIG. 8, one surface 211 of a first cover 210 of a soundproof cover 200 may be provided with an inlet communication hole 2115 through which the inlet portion 16 is arranged and a discharge communication hole 2113 through which the discharge portion 11 is arranged.

The compression unit 15 may define a first height h1 in the longitudinal direction of the rotary shaft 14, and the drive unit 13 may define a second height h2 in the longitudinal direction of the rotary shaft 14. A second cover 230 may accommodate the compressor 1 including the first height h1 and the second height h2.

One surface 251 of the third cover 250 may define an opening 2511 through which the cabinet 10 passes, and a side surface 253 may surround an outer circumferential surface of the cabinet 10.

In some implementations, the soundproof cover 200 may define a space for accommodating the outer surface of the compressor 1 including the drive unit 13 and the compression unit 15 from the top of the compressor 1, and one surface 251 of the third cover 250 may be spaced apart from the lower surface of the compressor 1 by a predetermined height.

The radiated noise generated in the compression unit 15 or the drive unit 13 may be insulated by the second cover 230 due to the above-described structure. The structural noise caused by vibration of the compressor 1 may be insulated as the one surface of the third cover 250 is spaced apart from the lower surface of the compressor 1 by the predetermined height.

The first cover 210, the second cover 230, and the third cover 250 may be arranged so as to be detachably attached to each other, and the second cover 230 may have at least two plates stacked from the inside of the accommodating space to the outside of the accommodating space.

The connection parts 220 and 240 and stack structure of the plates are configured as described above.

Figure 9:
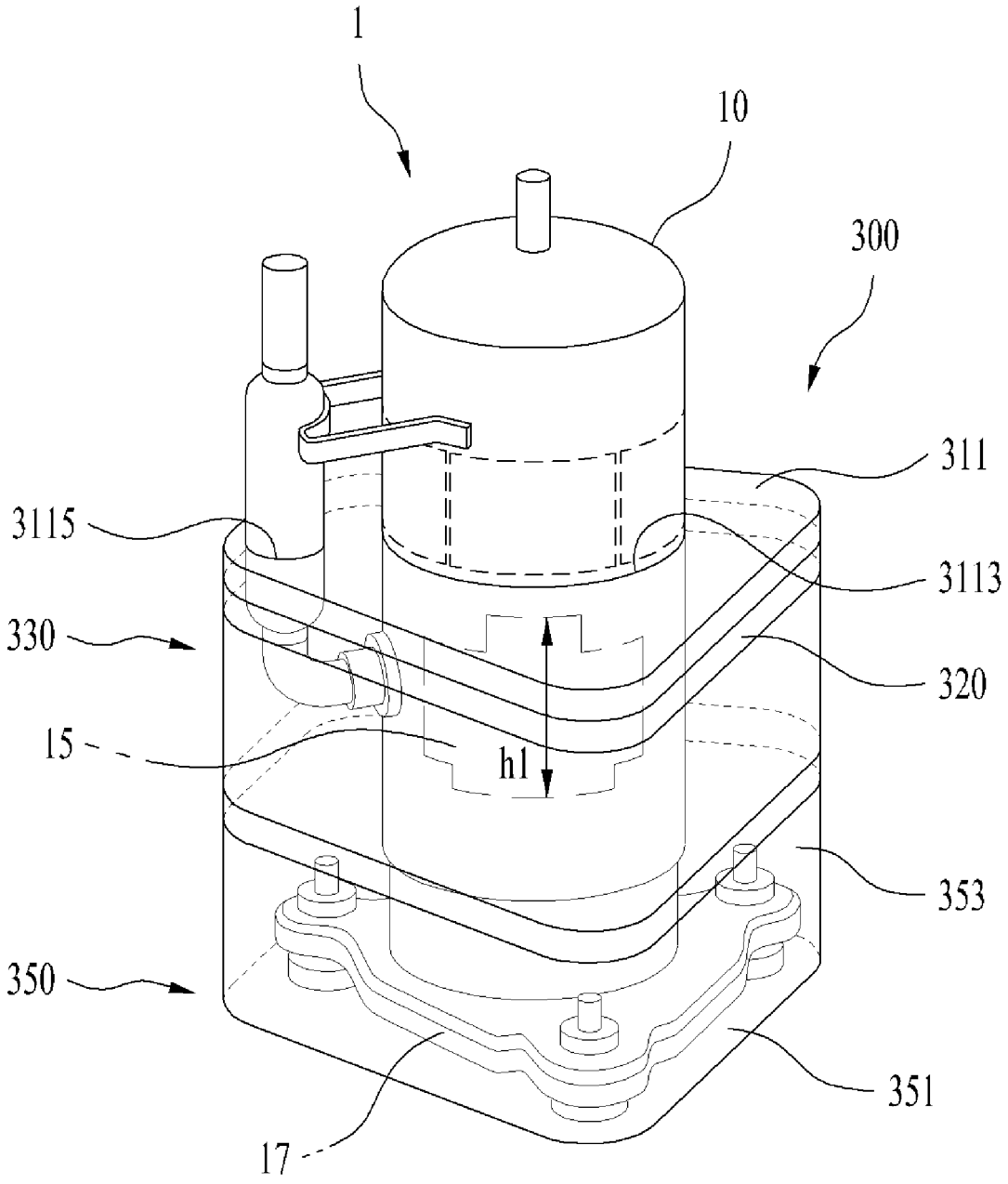
FIG. 9 is a view showing an example soundproof cover accommodating a compressor.

FIG. 9 is a view showing an example soundproof cover accommodating a compressor.

Referring to FIG. 9, one surface 311 of the first cover 310 of the soundproof cover 300 may be provided with an opening 3113 through which the cabinet 10 is arranged in a penetrating manner and a communication hole 3115 through which the inlet portion 16 is arranged in a penetrating manner. For example, the cabinet 10 may pass through the opening 3113 and extend vertically above an upper surface of the surface 311, and the inlet portion 16 may pass through the communication hole 3115 and extend vertically above the upper surface of the surface 311.

The compression unit 15 may define a first height h1 in the longitudinal direction of the rotary shaft 14, and the second cover 330 may accommodate the compressor 1 including the first height h1.

The fixing portion 17 may include a fixing hole 171 into which a screw 18 is inserted, and one surface 351 of the third cover 350 may be provided with a hole 3511 corresponding to the position of the fixing hole 171. The screw 18 may be arranged through the hole 3511 in a penetrating manner.

The compressor 1 generates noises during compression of the refrigerant. Particularly, the noise is intensively generated in the compression unit 15. With the above-described structure, the radiated noise generated in the compression unit 15 may be intensively insulated.

The first cover 310, the second cover 330, and the third cover 350 may be arranged so as to be detachably attached to each other, and the second cover 330 may have at least two plates stacked from the inside of the accommodating space to the outside of the accommodating space. The covers may be made of different materials.

The connection parts 220 and 240 and the stack structure of the plates, and the different materials constituting the respective covers may be configured as described above.

As apparent from the above description, the present disclosure has effects as follows.

In some implementations, radiated noise and structural noise generated in the compressor may be effectively blocked. In addition, the assembly operation may be facilitated, and accordingly mass productivity and assemblability may be improved.

An air layer is formed between the compressor and the soundproof cover. Accordingly, noise may be prevented from being transmitted to the outside of the soundproof cover.

In addition, as a connection part is used, noise leaking to the outside of the soundproof cover may be reduced.

In addition, as the soundproof cover is provided to a portion of the compressor that compresses the refrigerant and generates severe noise among internal elements of the compressor, noise may be intensively reduced.

Further, since the perforation type insulation member, a sound absorbing member, a sound insulating member are stacked on each other, sound absorption and sound insulation may be performed at the same time. In addition, a resonance structure may be formed by perforation, thereby increasing the sound absorption rate in a low frequency band.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. A cover for a compressor, wherein the compressor includes a compression unit that is configured to compress refrigerant, a drive unit that includes a stator, a rotor configured to be rotated by the stator, and a rotating shaft coupled to the rotor and connected to the compression unit, and a cabinet that accommodates the compression unit and the driving unit, wherein the cover defines an accommodating space configured to receive the cabinet of the compressor, the cover comprising:

a first cover configured to be spaced apart from an outer surface of the cabinet;

a second cover detachably attached to the first cover and configured to be spaced apart from the outer surface of the cabinet; and a connection part that is disposed between the first cover and the second cover and connects the first cover and the second cover to each other, the connection part extending along a circumference of each of the first cover and the second cover, wherein the first cover and the second cover are configured to reduce transmission of noise generated from the compressor to an outside of the accommodating space, wherein one of the first cover or the second cover is configured to accommodate one of the compression unit or the drive unit, and the other of the first cover or the second cover is configured to accommodate the other of the compression unit or the drive unit, and wherein the connection part is disposed at an area corresponding to an area between the compression unit and the driving unit, the connection part being made of a magnetic material and configured to allow the first cover and the second cover to be separated.

2. The cover of claim 1, wherein the first cover and the second cover are made of different materials.

3. The cover of claim 2, wherein the first cover and the second cover are made by staking a plurality of plates.

4. The cover of claim 3, wherein the plurality of plates comprise:

a first plate that defines an inner surface of the cover facing the accommodating space, the first plate defining a plurality of holes configured to reduce transmission of the noise;

a second plate stacked on the first plate and configured to absorb the noise; and a third plate that is stacked on the second plate, that defines an outer surface of the cover, and that is configured to reduce transmission of the noise.

5. A cover for a compressor, wherein the compressor includes a compression unit configured to compress refrigerant, a drive unit configured to drive the compression unit, and a cabinet that accommodates the compression unit and the driving unit, the cover defining an accommodating space configured to receive the cabinet of the compressor, the cover comprising:

a first cover that extends along a longitudinal direction of the cabinet from a perimeter of a first surface of the first cover, the first cover defining a first portion of the accommodating space configured to receive a first end of the cabinet;

a second cover detachably attached to the first cover and spaced apart from an outer surface of the cabinet, the second cover defining a second portion of the accommodating space;

a third cover that is detachably attached to the second cover and that extends along the longitudinal direction of the cabinet from a perimeter of a first surface of the third cover, the third cover defining a third portion of the accommodating space configured to receive a second end of the cabinet opposite to the first end;

a first connection part disposed between the first cover and the second cover and configured to connect the first cover and the second cover to each other, the first connection part extending along a circumference of each of the first cover and the second cover; and a second connection part disposed between the second cover and the third cover and configured to connect the second cover and the third cover to each other, the second connection part extending along the circumference of the second cover and a circumference of the third cover, wherein one of the first cover or the second cover is configured to accommodate one of the compression unit or the drive unit, and the other of the first cover or the second cover is configured to accommodate the other of the compression unit or the drive unit, and wherein the first connection part is disposed at an area corresponding to an area between the compression unit and the driving unit, the first connection part being made of a magnetic material and configured to allow the first cover and the second cover to be separated.

6. The cover of claim 5, wherein the cabinet comprises an inlet portion disposed at a first side of the cabinet and configured to introduce the refrigerant and a discharge portion disposed at the first side of the cabinet and configured to discharge the refrigerant, and wherein the compressor further includes:

a rotary shaft that extends from the drive unit in a direction away from the discharge portion and that is configured to rotate; and a fixing portion configured to fix the compressor to a ground.

7. The cover of claim 6, wherein the first surface of the first cover defines a communication hole configured to receive the inlet portion or the discharge portion, and wherein the inlet portion or the discharge portion is configured to penetrate the communication hole.

8. The cover of claim 7, wherein the second cover extends in the longitudinal direction to cover the compression unit having a first height and the drive unit having a second height.

9. The cover of claim 8, wherein the first surface of the third cover defines an opening configured to receive the cabinet, and wherein the cabinet is configured to penetrate the opening.

10. The cover of claim 6, wherein the first surface of the first cover defines a communication hole configured to receive the inlet portion and an opening configured to receive the cabinet, and wherein the inlet portion is configured to penetrate the communication hole, and the cabinet is configured to penetrate the opening.

11. The cover of claim 10, wherein the second cover extends along the longitudinal direction to cover the compression unit having a first height.

12. The cover of claim 11, wherein the first surface of the third cover defines a coupling hole at a position corresponding to a fixing hole defined by the fixing portion, the coupling hole being configured to receive a screw passing through the fixing hole.

13. The cover of claim 5, wherein the first connection part and the second connection part are made of a magnetic material.

14. The cover of claim 5, wherein the second cover and the third cover are made of different materials.

15. The cover of claim 14, wherein the second cover comprises a plurality of plates that are stacked in a direction from an inside of the accommodating space to the outside of the accommodating space.

16. The cover of claim 15, wherein the plurality of plates comprise:

a first plate that defines an inner surface of the cover facing the accommodating space, the first plate defining a plurality of holes configured to reduce transmission of noise;

a second plate stacked on the first plate and configured to absorb the noise; and a third plate that is stacked on the second plate, that defines an outer surface of the cover, and that is configured to reduce transmission of the noise.

17. The cover of claim 5, wherein the first surface of the first cover defines a predetermined inclination angle with respect to a plane parallel to the first surface of the third cover.

* * * * *